United States Patent [19]

Boysen

[11] 4,148,205

[45] Apr. 10, 1979

[54] REVERSE BENDING TOOL

[76] Inventor: Richard L. Boysen, 100 County Rd., Simsbury, Conn. 06070

[21] Appl. No.: 900,987

[22] Filed: Apr. 28, 1978

[51] Int. Cl.[2] ..... B21D 5/08

[52] U.S. Cl. ..... 72/176; 72/379; 72/479

[58] Field of Search ..... 72/166, 176, 379, 475, 72/479; 113/54 R, 57

[56] References Cited

U.S. PATENT DOCUMENTS

| | | | |
|---|---|---|---|
| 511,764 | 1/1894 | Eckel | 113/54 |
| 541,621 | 6/1895 | Langlais | 113/54 X |
| 3,119,432 | 1/1964 | Rogers | 72/176 X |
| 3,343,394 | 9/1967 | Gauer | 72/211 X |
| 3,387,478 | 6/1968 | Burr | 72/176 |
| 3,680,346 | 8/1972 | Wilcox | 72/211 X |

*Primary Examiner*—Leon Gilden

*Attorney, Agent, or Firm*—Daniel Jay Tick

[57] ABSTRACT

A reverse bending tool for bending a workpiece bent at a right angle to a reverse curve has a support angle iron and a guide angle iron forming an enclosed space of rectangular cross-section therebetween and extending along the lengths thereof. A shaping member is secured in the space between the support and guide angle irons. The workpiece is drawn between the shaping member and inner surfaces of plates of the support and guide angle irons.

2 Claims, 5 Drawing Figures

REVERSE BENDING TOOL

BACKGROUND OF THE INVENTION

The present invention relates to a reverse bending tool. More particularly, the invention relates to a reverse bending tool for bending a workpiece bent at a substantially right angle to a reverse curve.

Reverse bending tools of the type described herein are disclosed in U.S. Pat. Nos. 146,272; 229,418; 1,823,489; 2,434,401; 3,119,432; 3,343,394; 3,387,478 and 3,680,346.

Objects of the invention are to provide a reverse bending tool of simple structure, which is inexpensive in manufacture, used with facility, convenience and rapidity, and functions efficiently, effectively and reliably to bend a workpiece initially bent at a substantially right angle in the shape of a 90° dihedral to a reverse curve or substantially zero degree dihedral. The reverse bending tool of the invention is especially adaptable for use in the aluminum siding of structures, wherein the improved reverse bend may be utilized to hide the J channel and to provide a watertight seal of the trim on the side of the structure. The reverse bending tool of the invention also permits trimming after the installation of the siding more rapidly and with greater facility than do the known devices. The reverse bending tool of the invention seals the joints in the siding of a structure and insures that cracks, open seams and loose joints are eliminated as far as the transfer of moisture into the structure is concerned. The reverse bending tool of the invention is equally usable with sheet metal and metal initially bent at a substantially right angle to form a 90° dihedral.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
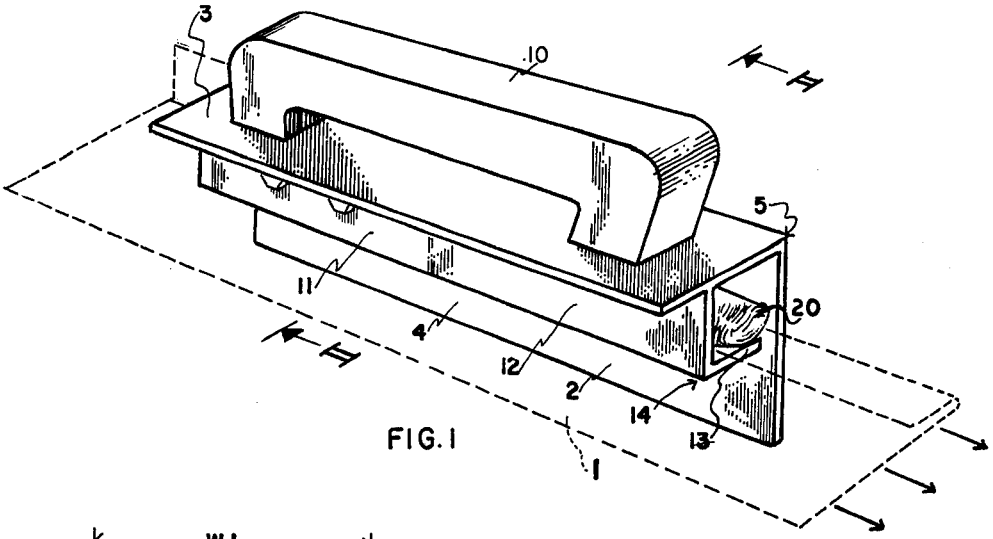
FIG. 1 is a perspective view of an embodiment of the reverse bending tool of the invention.
Figure 3:
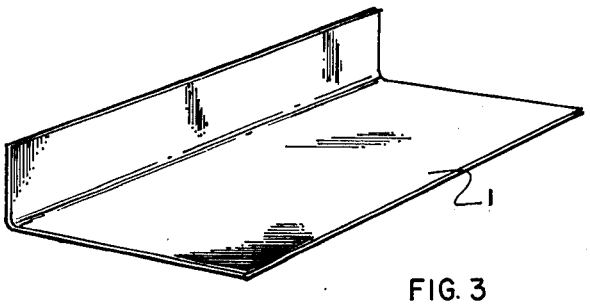
FIG. 3 is a perspective view of a workpiece before it is bent by the reverse bending tool of the invention.
Figure 4:
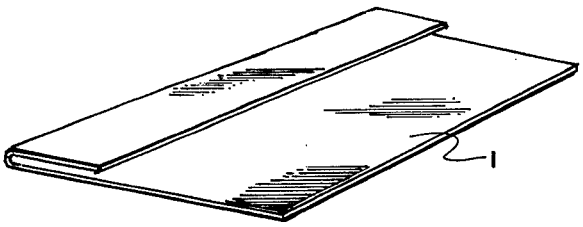
FIG. 4 is a perspective view of the workpiece of FIG. 3 after it has been bent by the reverse bending tool of the invention.

The reverse bending tool of the invention bends a workpiece 1 (FIGS. 1, 3 and 4) initially bent at a substantially right angle, as shown in FIGS. 1 and 3, to initially form a substantially 90° dihedral to a reverse curve or substantially zero degree dihedral, as shown in FIGS. 1 and 4.

Figure 2:
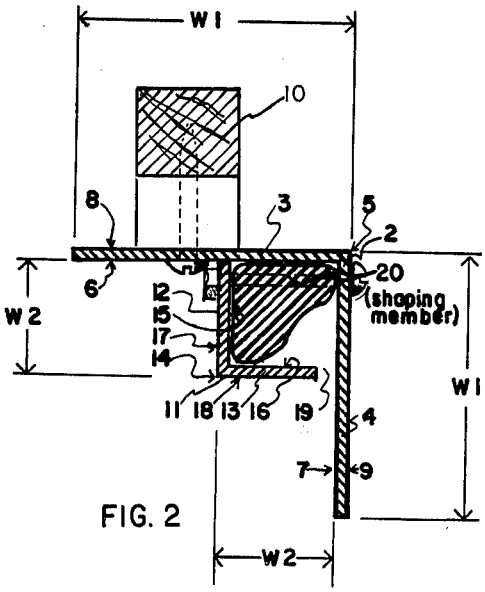
FIG. 2 is a cross-sectional view, on an enlarged scale, taken along the lines II—II, of FIG. 1.

The reverse bending tool of the invention comprises a support angle iron 2 (FIGS. 1 and 2) having first and second plates 3 and 4, respectively, joining each other at right angles along a length edge 5 of each, as shown in FIGS. 1 and 2. The first and second plates 3 and 4 have inner surfaces 6 and 7, respectively, and outer surfaces 8 and 9, respectively, as shown in FIG. 2. The first and second plates 3 and 4 of the support angle iron 2 have a predetermined width W1.

A handle 10 is affixed to the outer surface 8 of the first plate 3 of the support angle iron 2, as shown in FIGS. 1 and 2.

The reverse bending tool of the invention, as shown in FIGS. 1 and 2, further comprises a guide angle iron 11 having first and second plates 12 and 13, respectively, joining each other at right angles along a length edge 14 of each. The first and second plates 12 and 13 of the guide angle iron 11 have inner surfaces 15 and 16, respectively, and outer surfaces 17 and 18, respectively, as shown in FIG. 2. The first and second plates 12 and 13 of the guide angle iron 11 have a width W2 (FIG. 2) smaller than the predetermined width W1 of the first and second plates 3 and 4 of the support angle iron 2.

As shown in FIGS. 1 and 2, the guide angle iron 11 extends from the support angle iron 2 with the first plate 12 of said guide angle iron extending substantially perpendicularly from the inner surface 6 of the first plate 3 of said support angle iron in spaced relation with the inner surface 7 of the second plate 4 of said support angle iron. The second plate 13 of the guide angle iron 11 extends substantially perpendicularly to the second plate 4 of the support angle iron 2, but spaced from the inner surface 7 of said second plate of said support angle iron by a gap 19 (FIG. 2). The support angle iron and the guide angle iron 11 thus enclose a space of substantially rectangular cross-section therebetween.

Figure 5:
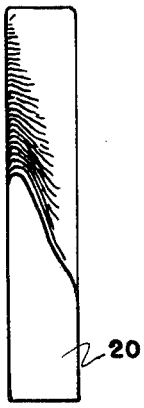
FIG. 5 is a view of an embodiment of the shaping member of the reverse bending tool of the invention.

A shaping member 20, which preferably comprises wood (FIGS. 1, 2 and 5) is secured in the space between the support angle iron 2 and the guide angle iron 11, as shown in FIGS. 1 and 2. The shaping member 20, which may also be known as a plow, has a cross-section shaped to bend the right angle of the workpiece 1, shown in FIG. 3, to a reverse angle, shown in FIG. 4. The shaping member 20 preferably consists of wood.

The reverse bending tool of the invention is utilized by drawing or pulling the workpiece 1 between the shaping member 20 and the inner surface 7 and 16 of the second plates 4 and 13, respectively, of the support angle iron 2 and the guide angle iron 11, respectively. Alternatively, the reverse bending tool of the invention is moved along the workpiece 1 after said workpiece is initially positioned between the shaping member 20 and the inner surface 7 of the second plate 4 of the support angle iron 2.

While the invention has been described by means of a specific example and in a specific embodiment, I do not wish to be limited thereto, for obvious modifications will occur to those skilled in the art without departing from the spirit and scope of the invention.

I claim:

1. A reverse bending tool for bending a workpiece bent at a substantially right angle to a reverse curve, said reverse bending tool comprising a support angle iron having first and second plates joining each other at right angles along a length edge of each, each of said plates having an inner surface and an outer surface, each of the first and second plates having a predetermined width;

a handle affixed to the outer surface of the first plate of the support angle iron;

a guide angle iron having first and second plates joining each other at right angles along a length edge of each, each of said plates having an inner surface and an outer surface, each of the first and second plates of the guide angle iron having a width smaller than the predetermined width, said guide angle iron extending from the support angle iron with the first plate of said guide angle iron extending substantially perpendicular from the inner surface of the first plate of said support angle iron in spaced relation with the inner surface of the second plate of said support angle iron and the second plate of said guide angle iron extending substantially perpendicularly to the second plate of said support angle iron but spaced from the inner surface of the second plate of said support angle iron by a gap whereby said support and guide angle irons enclose a space of substantially rectangular cross-section therebetween; and a shaping member secured in the space between said support and guide angle irons, the workpiece being drawn between the shaping member and the inner surfaces of the second plates of said support and guide angle irons.

2. A reverse bending tool as claimed in claim 1, wherein said shaping member has a cross-section shaped to bend the right angle of the workpiece to a reverse angle.

* * * * *